US008381809B2

(12) United States Patent
White

(10) Patent No.: US 8,381,809 B2
(45) **Date of Patent: *Feb. 26, 2013**

(54) PACKER WITH NON-EXTRUSION RING

(76) Inventor: Max White, Arlington, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/436,586

(22) Filed: Mar. 30, 2012

(65) Prior Publication Data

US 2012/0187632 A1 Jul. 26, 2012

Related U.S. Application Data

(63) Continuation of application No. 12/559,283, filed on Sep. 14, 2009, now Pat. No. 8,167,033.

(51) Int. Cl.
*E21B 33/128* (2006.01)

(52) U.S. Cl. ..... 166/196; 166/134; 277/338; 277/339; 277/341; 277/342; 277/533; 277/619; 277/638

(58) Field of Classification Search ..... 166/134, 166/179, 187, 196, 387, 138; 277/337, 338, 277/339, 340, 341, 342, 531, 532, 533, 619, 277/638

See application file for complete search history.

(56) References Cited

U.S. PATENT DOCUMENTS

| | | | | | |
|---|---|---|---|---|---|
| 2,430,623 | A * | 11/1947 | Taylor, Jr. et al. | ..... | 166/131 |
| 2,797,758 | A * | 7/1957 | Showalter | ..... | 277/342 |
| 3,776,561 | A * | 12/1973 | Haney | ..... | 277/340 |
| 4,452,463 | A * | 6/1984 | Buckner | ..... | 277/338 |
| 6,578,638 | B2 * | 6/2003 | Guillory et al. | ..... | 166/387 |

* cited by examiner

*Primary Examiner* — Giovanna Wright
*Assistant Examiner* — Richard Alker
(74) *Attorney, Agent, or Firm* — Shannon W. Bates; Klemchuk Kubasta LLP

(57) ABSTRACT

Embodiments of the present disclosure generally provide a packer for use within a conduit, such as casing, having a non-extrusion ring. The non-extrusion ring is comprised of hard segments and an elastic matrix.

19 Claims, 5 Drawing Sheets

PACKER WITH NON-EXTRUSION RING

CROSS REFERENCE TO RELATED APPLICATIONS

The present application is a continuation of U.S. patent application Ser. No. 12/559,283 filed Sep. 14, 2009 and entitled "Packer with Non-Extrusion Ring," which is incorporated herein by reference for all purposes.

TECHNICAL FIELD

The disclosure relates generally to down-hole equipment, and in particular to a packer with a non-extrusion ring.

BACKGROUND

Packers are used to seal portions of conduit, such as casing, against fluid flow. Such devices are common in oil and gas wells, but may be used in other types of conduit as well.

SUMMARY

Embodiments of the present disclosure generally provide a packer system for use within a conduit, such as casing, having a non-extrusion ring. The non-extrusion ring is comprised of hard segments and an elastic matrix.

Other technical features may be readily apparent to one skilled in the art from the following drawings, descriptions and claims.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

Figure 1:
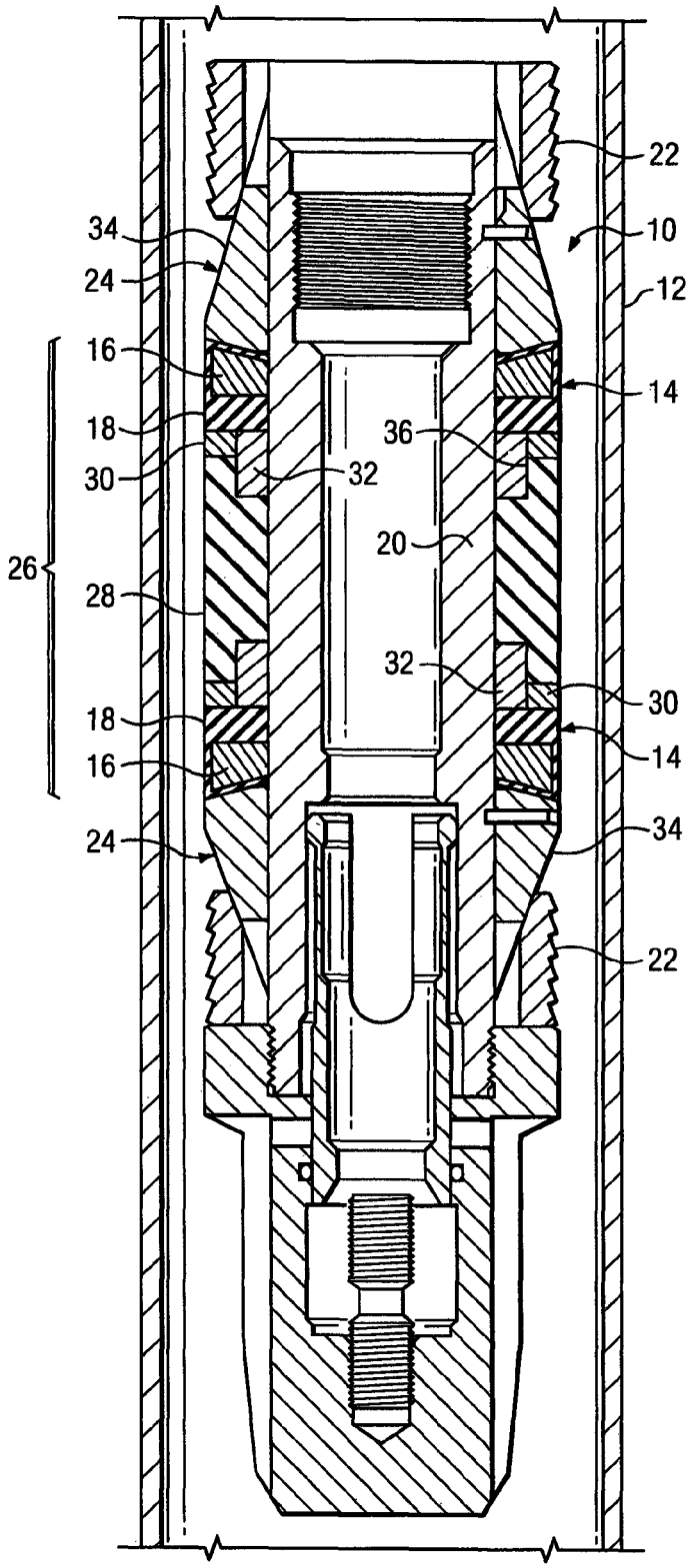
FIG. 1 is a sectional view of a packer in a retracted state.

The present disclosure generally provides a packer 10 for use within a conduit 12, such as casing, having a non-extrusion ring 14. The non-extrusion ring 14 is comprised of hard segments 16 an elastomeric matrix 18.

*Fig.* 1 is a sectional view of a packer 10 in a retracted state. Packer 10 has a central mandrel 20 and slips 22 to secure packer 10 within conduit 12. Forcing cones 24 move axially along mandrel 20. Between forcing cones 24 is a packing element 26. Packing element 26 is comprised of a principal element 28 with a support ring 30, inner ring 32 and a non-extrusion ring 14 on each end. Principal element 28 is an elastomeric seal with a recess 36 in each end. Recess 36 is sized to accommodate inner ring 32 while the packer 10 is in a retracted state.

Figure 2:
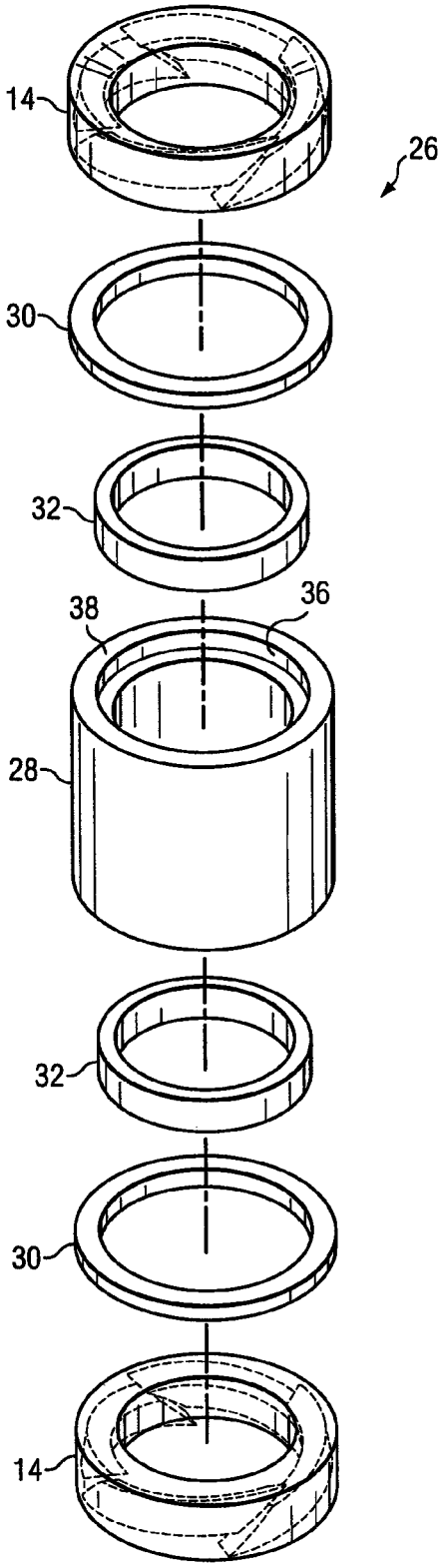
FIG. 2 is an exploded view of a packing element.

FIG. 2 is an exploded view of packing element 26 according to one embodiment of the present disclosure. In the middle of the packing element 26 is principal element 28. In this view recess 36 is shown extending around the interior of the principal element 28 creating a shoulder 38 on each end of the principal element 26. Inner ring 32 sits inside of shoulder 38, within recess 36, while support ring 30 sits on shoulder 38. Inner ring 32 is sized to slide within support ring 30 and recess 36 is sized to allow inner ring 32 to be flush with support ring 30 when the packing element 26 is assembled as shown in FIG. 3.

FIG. 2 shows that each end of packing element 26 has the same structure: the non-extrusion ring 14, the support ring 30 and the inner ring 32.

Figure 3:
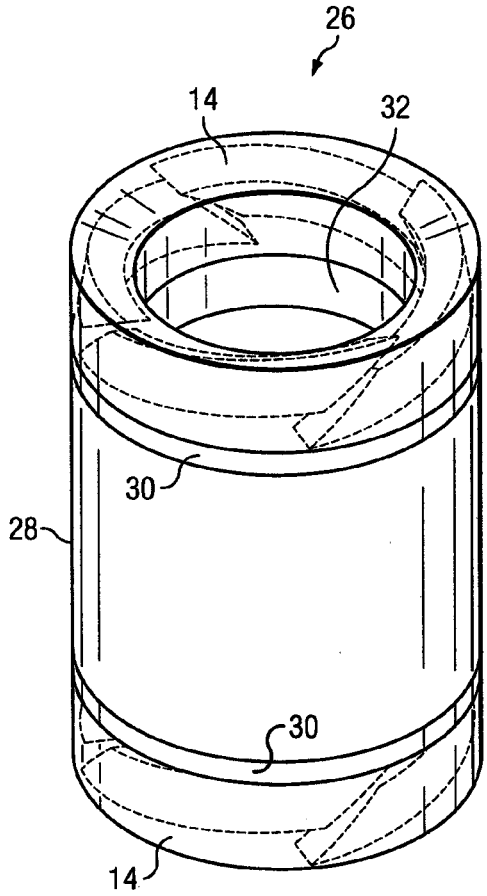
FIG. 3 is an assembled view of the packing element of FIG. 2.

FIG. 3 is an assembled view of the packing element 26 of FIG. 2. The assembled packing element 26 shows the relationship of the various parts of FIG. 2 when placed into a packer 10.

Figure 4A:
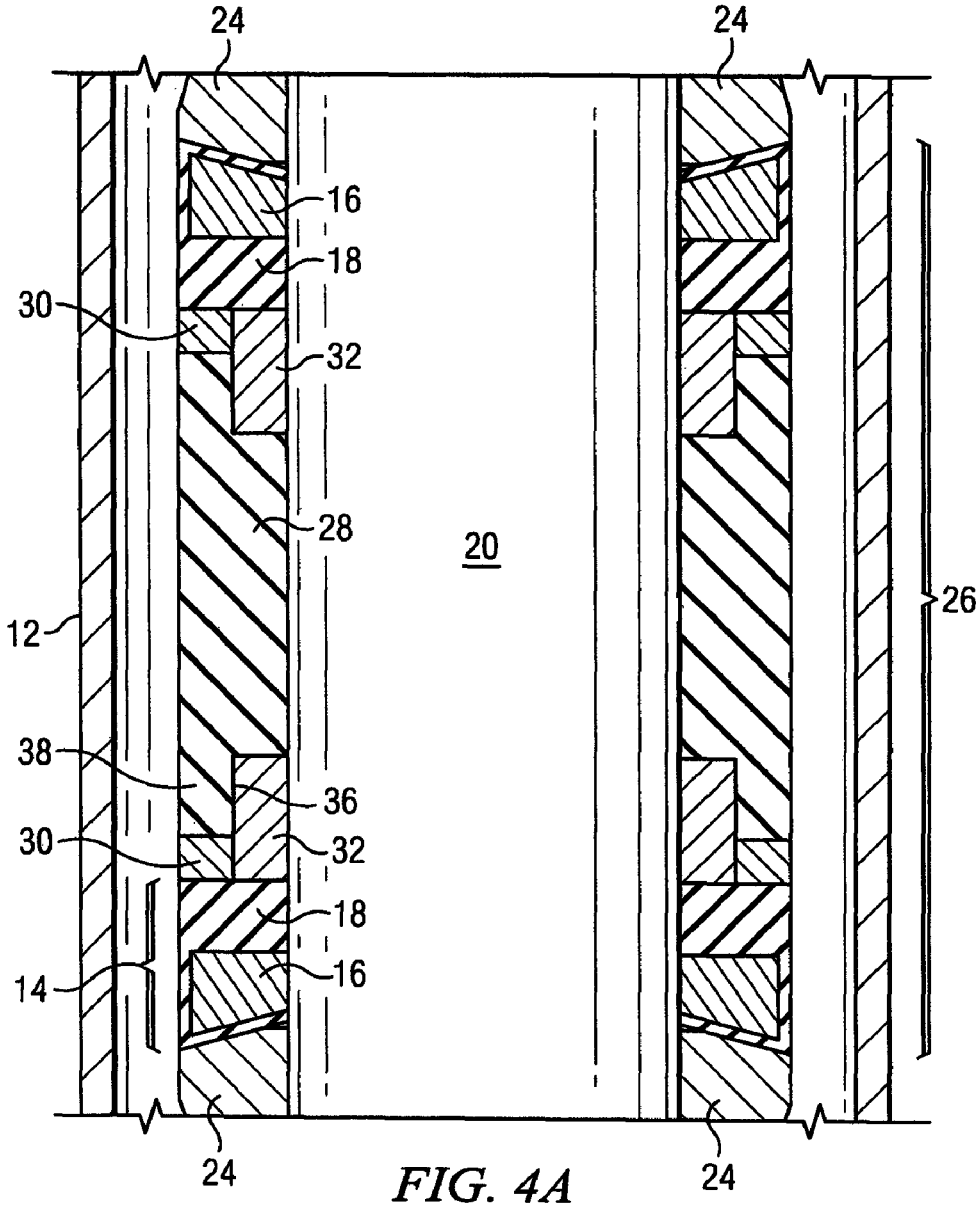
FIG. 4A is a sectional close-up view of a packing element in a retracted state.

FIG. 4A is a sectional close-up view of a packing element 26 in a retracted state, within a packer 10 according to one embodiment of the present disclosure. Principal element 28 is shown with inner ring 32 within recess 36 and support ring 30 on shoulder 38, support ring 30 and inner ring 32 being flush with .one another where they meet non-extrusion ring 14. Non-extrusion ring 14 has a slanted face adjacent to forcing cone 24. Non-extrusion ring 14 has hard segments 16 within an elastomeric matrix 18.

Figure 4B:
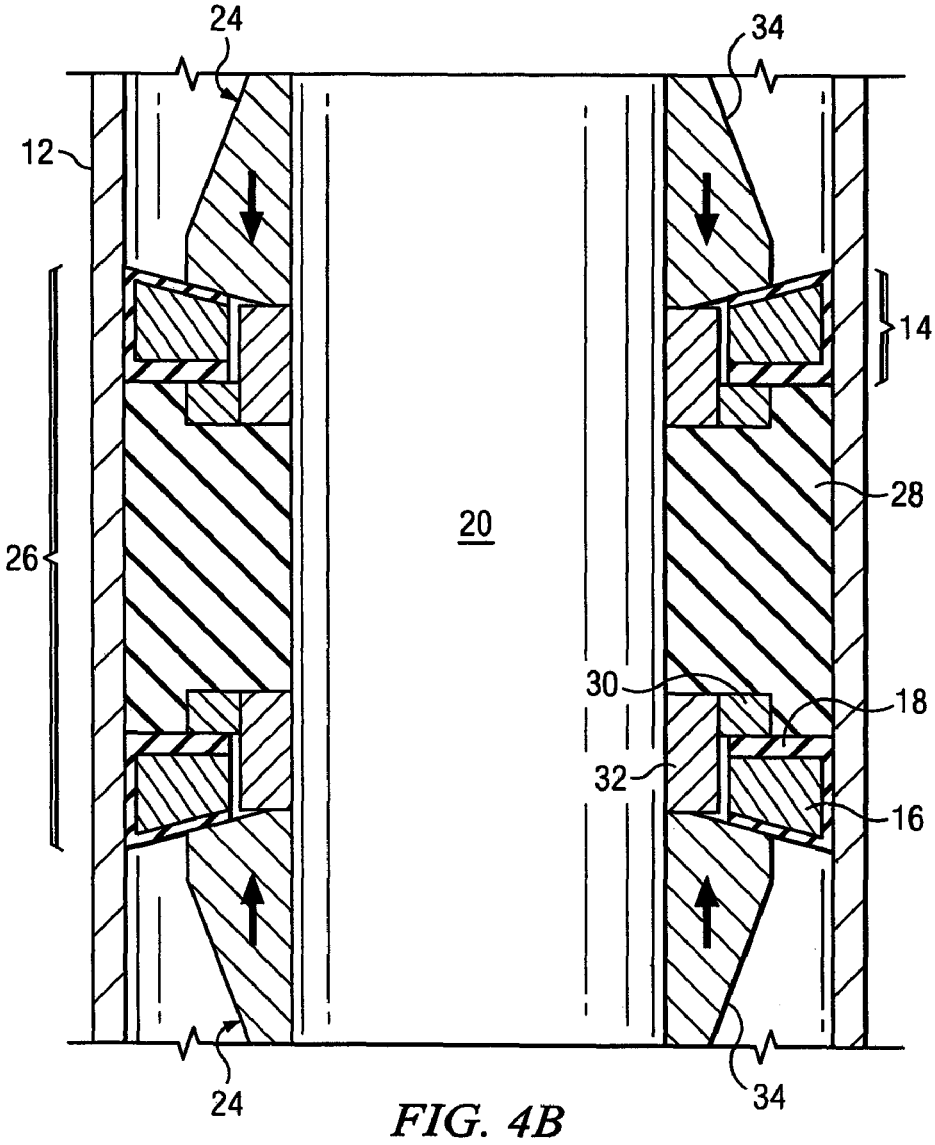
FIG. 4B is a sectional close-up view of a packing element in an engaged state.

FIG. 4B is a sectional close-up view of a packing element 26 in an engaged state where forcing cones 24 are moved axially along the mandrel 20 towards each other according to one embodiment of the present disclosure. The inclined planes of the forcing cones 24 have pushed the non-extrusion ring 14 out to the conduit 12 and the pressure on principal element 28 has been squeezed. the conduit 12 as well. Under this pressure inner ring 32 slides within conical support ring 30 to abut forcing cone 24. Inner ring 32, support ring 30 and non-extrusion ring 14 form a seal between mandrel 20 and conduit. 12 to contain principal element 28 from extruding between the forcing cones 24 and the conduit 12.

Figure 5A:
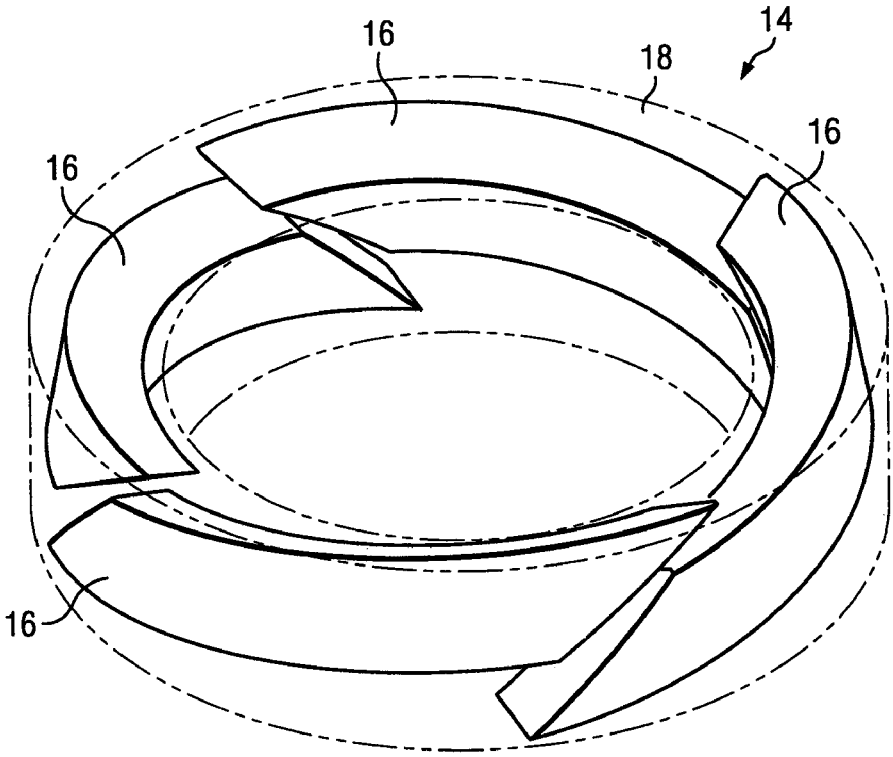
FIG. 5A is an isometric view of the segments within a non-extrusion ring in a retracted state.

FIG. 5A is an isometric view of the hard segments 16 within the non-extrusion ring 14 in a retracted state. Hard segments 16 are arranged within the elastomeric matrix 18 in a vertically overlapping fashion.

Figure 5B:
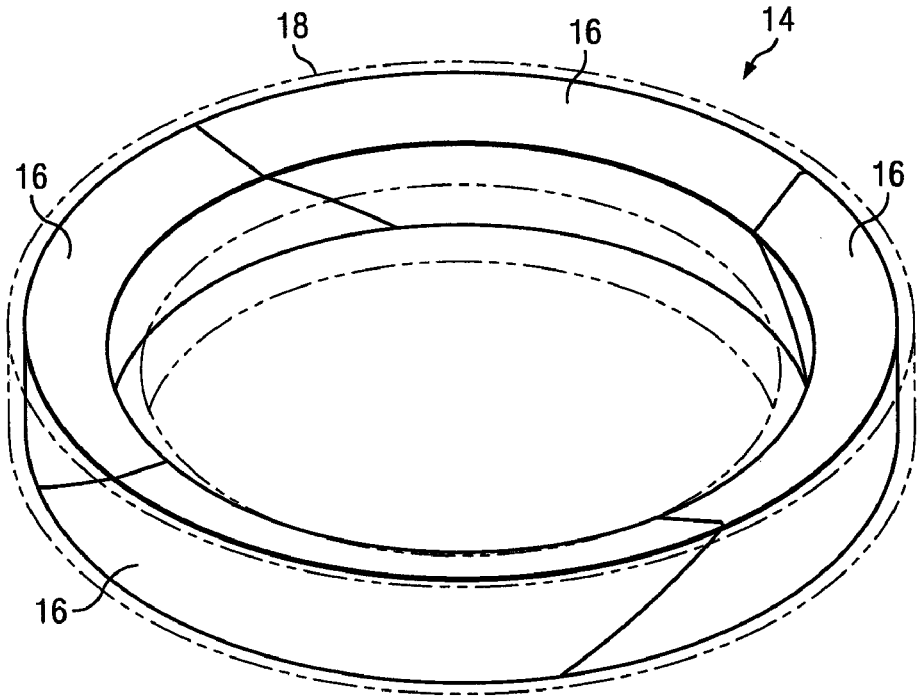
FIG. 5B is an isometric view of the segments within a non-extrusion ring in an engaged state.

FIG. 5B is an isometric view of the hard segments 16 within a non-extrusion ring 14 in an engaged state. Hard segments 16 have been fully expanded and form a near solid ring of rigid material within the elastomeric matrix 18. A comparison of FIG. 5A to FIG. 5B shows that hard segments 16 may be formed by slicing a rigid ring of the desired size into multiple hard segments 16 along a bias. The number of hard segments 16 may be adjusted, four hard segments 16 are shown in FIGS. 5A and 5B, but five or six hard segments 16 may be used for larger non-extrusion rings 14. The number of hard segments 16 will typically increase as the diameter of the non-extrusion ring 14 increases.

Hard segments 16 and support ring 30 may be made of multiple materials depending on the desired properties, some examples would include metals, such as steel, copper, bronze, aluminum, brass, cast iron, composite bronze, or ductile metal, or rigid plastics, such as phynolic thermal resins and similar rigid plastics. Likewise, elastomeric matrix 18 may be made from a variety of elastomers such as vulcanized rubber, either natural or synthetic, of varying hardnesses or durometers. The selection of materials for the non-extrusion. ring 14 depends on the rigidity needed, the anticipated corrosiveness of the setting, the bonding between the elastomeric matrix 18 and hard segments 16, and the speed. with which the non-extrusion ring 14 is expected to engage the conduit 12. All of these factors are balanced when selecting materials for the hard segments 16 and elastomeric matrix 18 of a non-extrusion ring 14. If appropriate, aluminum will be favored for hard segments 16 because of it relatively high strength and ease of drillability after use.

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A non-extrusion ring for sealing against the inner diameter of a casing, the non-extrusion ring comprising:

a plurality of segments arranged in a vertically overlapping manner, each segment having an outer surface, an inner surface, an upper surface and slanted end surfaces, the outer surfaces of the segments having a curvature that approximates the inner diameter of the casing; and a flexible matrix substantially fully surrounding the segments and maintaining the segments in the vertically overlapping manner while in a relaxed state, but allowing the segments to move radially when force is exerted on the non-extrusion ring.

2. The non-extrusion ring of claim 1, wherein the upper surfaces of the segments are slanted.

3. The non-extrusion ring of claim 1, further comprising a slanted upper surface of the non-extrusion ring.

4. The non-extrusion ring of claim 1, wherein the flexible matrix is vulcanized rubber.

5. The non-extrusion ring of claim 1, wherein the segments move radially under force to form a near solid ring of segments within the flexible matrix and against the inner diameter of the casing.

6. The non-extrusion ring of claim 1, wherein the segments are metal.

7. The non-extrusion ring of claim 6, wherein the metal is steel, aluminum, bronze, cast iron, or brass.

8. The non-extrusion ring of claim 6, wherein the segments are formed by slicing a rigid ring of metal.

9. The non-extrusion ring of claim 8, wherein the segments are sliced to have slanted ends such that a first end of one segment overlaps a second end of an adjacent segment.

10. A sealing system comprising the non-extrusion ring of claim 1.

11. The sealing system of claim 10, further comprising a support ring engaging the non-extrusion ring; and an inner ring engaging the support ring;

wherein the non-extrusion ring stacks substantially flat onto the support ring and the support ring stacks substantially flat onto the inner ring.

12. The sealing system of claim 11, wherein the support ring and the inner ring are metal.

13. The sealing system of claim 12, wherein the metal is steel, aluminum, bronze, cast iron, or brass.

14. A method of forming a seal using the sealing system of claim 11, the method comprising:

exerting a force on the non-extrusion ring;

expanding the segments radially outward within the flexible matrix; and sealing the non-extrusion ring against the inner diameter of the casing.

15. The method of claim 14, wherein the sealed non-extrusion ring prevents extrusion of a packing element between the casing and the non-extrusion ring.

16. A method of forming a seal using a sealing system comprising a non-extrusion ring for sealing against the inner diameter of a casing, the non-extrusion ring comprising:

a plurality of segments arranged in a vertically overlapping manner, each segment having an outer surface, an inner surface, an upper surface and slanted end surfaces, the outer surfaces of the segments having a curvature that approximates the inner diameter of the casing;

a flexible matrix surrounding the segments and maintaining the segments in the vertically overlapping manner while in a relaxed state, but allowing the segments to move radially when force is exerted on the non-extrusion ring; and a support ring engaging the non-extrusion ring; and an inner ring engaging the support ring, the method comprising:

exerting a force on the non-extrusion ring;

expanding the segments radially outward within the flexible matrix;

sealing the non-extrusion ring against the inner diameter of the casing; and sliding the inner ring within the support ring in response to a pressure on the packing element;

wherein the sealed non-extrusion ring prevents extrusion of a packing element between the casing and the non-extrusion ring.

17. The method of claim 16, further comprising sealing the inner ring and the support ring against an inner mandrel.

18. The method of claim 17, wherein the sealed inner ring and the support ring prevents extrusion of the packing element between the inner mandrel and the sealing system.

19. The method of claim 18, further comprising the sealing system forming a seal to prevent extrusion of the packing element between the inner mandrel and the casing.

* * * * *